US008402927B2

(12) United States Patent
Home

(10) Patent No.: US 8,402,927 B2
(45) Date of Patent: Mar. 26, 2013

(54) WATER HEATER WITH ENHANCED THERMAL EFFICIENCY

(75) Inventor: William Home, Taipei (TW)

(73) Assignee: Grand Hall Enterprise Co., Ltd., Taipei (TW)

( * ) Notice: Subject to any disclaimer, the term of this patent is extended or adjusted under 35 U.S.C. 154(b) by 1006 days.

(21) Appl. No.: 12/429,196

(22) Filed: Apr. 24, 2009

(65) Prior Publication Data

US 2010/0269766 A1 Oct. 28, 2010

(51) Int. Cl.
*F24H 1/00* (2006.01)

(52) U.S. Cl. ..... 122/18.3; 122/15.1; 122/32

(58) Field of Classification Search ..... 122/15.1, 122/18.1, 18.3, 32
See application file for complete search history.

(56) References Cited

U.S. PATENT DOCUMENTS 1,452,676 A * 4/1923 Cole ..... 122/18.1
2,210,830 A * 8/1940 Bernhard ..... 122/156
4,280,450 A * 7/1981 Maruyama ..... 122/13.01
4,465,024 A * 8/1984 Adams ..... 122/17.2
6,378,777 B1 * 4/2002 Valcic et al. ..... 237/8 R
6,945,197 B2 * 9/2005 Ryoo ..... 122/15.1

* cited by examiner

*Primary Examiner* — Eric Keasel
*Assistant Examiner* — Ian Paquette
(74) *Attorney, Agent, or Firm* — Leong C. Lei

(57) ABSTRACT

A water heater with enhanced thermal efficiency includes a heat exchange tank, a water tank that houses the heat exchange tank and shields and isolates the heat exchange tank with a surrounding curtain of water flowing therethrough, a burner, and a blower. The burners is connected to a combustible gas outlet opening of the blower and extends from a central base of the heat exchange tank up into the heat exchange tank to form a combustion chamber within an internal cavity of the heat exchange tank. A plurality of radially arranged flame tubes extends downward from a top corner of the internal cavity and is enclosed by the water flowing inside the water tank. The flame tubes are extended to communicate an exhaust gas discharge tube set circumferentially of and separated from the base for discharging gas. Water inlet and outlet are respectively provided to the water tank.

5 Claims, 3 Drawing Sheets

WATER HEATER WITH ENHANCED THERMAL EFFICIENCY

TECHNICAL FIELD OF THE INVENTION

The present invention generally relates to a water heater with enhanced thermal efficiency for continuously supplying hot water of a stable temperature without suffering instantaneous drop of water pressure so as to enhance thermal efficiency and save energy consumption.

DESCRIPTION OF THE PRIOR ART

Some conventional water heaters are constructed to directly heat a water storage tank from the underside in order to supply hot water, and the other conventional water heaters are not provided with a water storage tank and are designed to directly heat a heat-conduction water conveyance tube. The water heat that does not have a water storage tank and is operated by directly heating the heat-conduction water conveyance tube comprises a body, a flame tube, a burner, and the heat-conduction water conveyance tube. The flame tube is arranged centrally inside the body and the burner is set below the flame tube. An inlet opening of the heat-conduction water conveyance tube extends downward through the body to connect to a cold tap water pipe through proper fitting. The heat-conduction water conveyance tube has a tubular body extending to a circumference of the flame tube to go spirally upward around the flame tube to have an outlet opening of the heat-conduction water conveyance tube projecting beyond the body to connect to a hot water supply tube. In this way, water that flows through the heat-conduction water conveyance tube is subjected to heating and becomes hot water. Such an arrangement of water heater is simple and easy to manufacture, yet it suffers certain drawbacks:

(1) Although adjacency of the burner, the flame tube, and the heat-conduction water conveyance tube is provided with ventilation holes, slits for heat dissipation, and smoke passages that communicates the atmosphere, excellent air ventilation can be realized and fresh air can be easily drawn in to facilitate combustion. However, since the site where combustion is carried out and heating is performed is almost open, the heat generated by combustion can be easily dissipated to the atmosphere. Without any enclosed space to keep the heat and high temperature and to confine the heat for realizing effective transfer of the heat, the efficiency of heat exchange is insufficient. Without conducting all the heat to the heat-conduction water conveyance tube to sufficiently heat the water inside the tube, the heat will spread outward to gradually heat the enclosure of the heater, leading to accident burning of a user touching the enclosure.

(2) Since the ventilation holes, the heat dissipation slits, and the smoke passages are formed with fixed opening sizes, airflows can only be induced by natural convection to travel through the burner and facilitate combustion. This makes it easily affected by being attacked by winds and storms to cause fast variation of air supplied to the burner, or even causing floating and dancing of flames. Further, the flow rate of hot water supplied to a tap varies depending on how wide a user opens the tap and if the flow rate of a combustible gas (such as petroleum gas) supplied to the water heater is set to be fixed, a quick variation of the water flow rate may lead to improper response that the water heater may take to adjust the air flow rate through natural convection, whereby it cannot maintain a precise and stable air/fuel ratio, which leads to potential risk of incomplete combustion and causes generation of toxicant gas, such as CO, which hurts people staying nearby. Further, the flame that is easily attacked by winds may lead to leakage of petroleum gas that may hurt people staying nearby. This, together with the above discussed drawback of incapability of completely transferring heat generated to the heat-conduction water conveyance tube, makes the thermal efficiency of the known water heater only 75-82%, which is apparently a cause for waste of energy and being uneconomic.

(3) Further, the conventional water heater must use a heat-conduction water conveyance tube that is thinner than the regular pipe for conveying heated water to a destination in order to efficiently heat the water flowing through the heat-conduction water conveyance tube. This makes it difficult to supply a large amount of water in each unit of time. It also needs to wait for quite a long time (approximately 5-15 minutes) before the water flowing out of the tap becomes hot. In case that a number of users or sites need to be supplied with hot water at the same time, the water pipe that is connected to the heat-conduction water conveyance tube and responds for conveying the hot water to the users or the destination sites will be incapable to supply all the hot water needed, leading to an apparent reduction of water pressure and making it impossible for the users to feel easy in using hot water.

The conventional water heaters that directly heat the water storage tank from the underside requires an even longer period of waiting for the large amount of water contained in the water storage tank must be heated by the burner long enough in order to bring the water to a desired high temperature. Although it is possible to instantaneously supply a large amount of hot water after the water storage tank has been completely heated, yet it is still very challenging to replenish heated water again once the storage of hot water has been consumed up. This makes the whole time period for showering undesirably extended and water temperature changes alternately between hot and cold, making it not possible for users to enjoy a hot bath. For both types of conventional water heaters, either those that are operated by directly heating the water storage tank from the underside or those that are not equipped with a water storage tank and are operated by directly heating the heat-conduction water conveyance tube, the combustion flame and heated gas generated by the burner can only travel upward during which period that they transfers heat to the water storage tank or the heat-conduction water conveyance tube. There is no structure provided to conduct the hot flame and gas to other portions of the water heater. Thus, only one time of heat exchange s available for heating water and this is a waste for the hot gas that ascends to the top to be discharged still contains a great amount of residual thermal energy that will be simply discharged to the atmosphere. The thermal energy generated by combustion is thus not fully exploited. This shows an apparent conclusion that the conventional water heaters have a poor thermal efficiency.

In view of all the drawbacks that conventional water heaters may possess, the present invention aims to provide a water heater that enjoys enhanced thermal efficiency to overcome the problems.

SUMMARY OF THE INVENTION

Thus, an objective of the present invention is to provide a water heater with enhanced thermal efficiency, which comprises a heat exchange tank, a water tank that houses the heat exchange tank and shields and isolates the heat exchange tank with a surrounding curtain of water flowing therethrough, a burner, and a blower for blowing combustible gas. The burners is connected to a combustible gas outlet opening of the blower and extends from a central base of the heat exchange tank up into the heat exchange tank to form a combustion chamber within an internal cavity of the heat exchange tank. A plurality of radially arranged flame tubes extends downward from a top corner of the internal cavity and is enclosed by the water flowing inside the water tank. The flame tubes are extended to communicate an exhaust gas discharge tube set circumferentially of and separated from a base of the heat exchange tank for discharging gas in an upward-bent direction. A cold water inlet is formed at a suitable location in a lower side portion of the water tank and a hot water outlet is formed in a central portion of a top of the water tank. Such a structure provides the following advantages:

(1) The internal space of the heat exchange tank in which combustion and heating performed by the burner is almost completely enclosed and is only in communication with the outlet of the blower and the flume tubes. A mixture formed of precisely mixed ratio of air and combustible gas is forcibly introduced through the blower, driving the combusted hot gas to pass through the top of the heat exchange tank and enter the flume tubes, whereby the combusted hot gas is guided in a completely controlled manner, eliminating any potential risk of heat dissipation through otherwise formed holes/openings, and complete heat exchange can be performed with water outside the top portion of water exchange tank and water outside the flume tubes that are arranged circumferentially of the heat exchange tank, so that extremely high thermal efficiency is available for heating water.

(2) The flame tubes have a cross-section that forms a wide flat tubular shape, which has a reduced inside-tube cross-sectional area as compared to a circular tube. The whole outer tubular wall is completely immersed in the water that flows inside the water tank, making it an enlarged heat dissipation surface area as compared to the circular tube used in the conventional water heaters, so that heat can be more efficiently transferred to the water and the heat exchange efficiency between the hot flame gas and the water is enhanced.

(3) Since forced driving of combustible gas formed of a mixture of air and fuel into the heat exchange tank for combustion is conducted through a blower to replace the natural convection, and since the modern theories concerning air/fuel ratio for achieving complete combustion is mature and proportional valve that is relied on to regulate the air/fuel ratio to achieve complete combustion can be operated in a very precise manner, the combustible gas that is introduced through the blower can be of a precisely set air/fuel ratio without being affected by any introduction of undesired external air currents in order to achieve complete combustion. This, together with the above mentioned high efficiency of heating water, makes the thermal efficiency as high as 98% in normal operations. In other words, the same amount of hot water that is of the same temperature can be supplied with reduced consumption of the combustible gas and saving of energy can be realized.

(4) Since the combustion is complete, no carbon deposition will be generated due to the combustion and the function of combustion of the water heater can be maintained long.

(5) Further, due to the combustion being complete, and since the burner is arranged in such a way to have a combustion occurring location set toward to top side in accordance with the orientation that heated gas flows upward, and also since the up-side-down arranged top portion of the heat exchanger accumulate no moisture residual, the air that enters the heat exchange tank with some moisture entraining therewith can be quickly dried out. This, together with the advantage mentioned above in item (3), provides an efficacy of extension of lifespan.

(6) Due to the complete combustion, almost no incompletely combusted toxicant gas is generated, such as CO. The combustion and heating site where the burner is located is almost completely enclosed inside the heat exchange tank, whereby even a minor amount of toxicant gas is generated, such toxicant gas will be expelled by the forcibly driven gas flow induced by the blower to safely discharge to an outdoor location through the exhaust gas discharge tube.

(7) Since a water passage is formed between the heat exchange tank and the water tank, when water to be heated is introduced, the water flow constantly brings away the heat transferred through the heat exchange tank and the flame tubes set around the heat exchange tank and thus simultaneously cool the water tank down, so that heat will not be transferred to the water tank and people will not be burnt due to accidental contact the outer wall of the water tank. This, together with the above mentioned advantage of item (6), makes the use of the water heater vary safe.

(8) Further, as discussed previously in item (2), the water heater of the present invention extends the flume tubes directly through water contained in the water tank to directly immerse the outer surfaces of the flame tubes in the water for efficiently transferring the heat carried by the flame gas to the water through the enlarged surface areas. To accommodate a number of flame tubes in order to have the outer surfaces immersed in water, a large space must be provided between the water tank and the outer circumferential wall of the heat exchange tank, as well as circumferentially outside the flume tubes, for water to flow therethrough. In this way, the water that is heated and becomes hot water, when supplied through the hot water outlet, to an external hot water conveyance pipe, will not be affected by abrupt change in cross-sectional area between front and rear tubes/pipes, which leads to incapability of timely supplying sufficient hot water to multiple sites and drop of water pressure, and thus allowing a number of users to use hot water without feeling uneasy.

(9) Further, the water heater with enhanced thermal efficiency according to the present invention arranges the flume tubes around the heat exchange tank and corresponding to the burner and is surrounded by water flow through the water tank. In addition, the water flow covers and isolates the top of the heat exchange tank and opposes the top of the burner. Piping leading to the cold water inlet port (coupled to cold tap water pipe) is arranged at a location close to where the hot exhaust gas is discharged, such as where the exhaust gas passes through the exhaust gas discharge tube and moves in an upward-bent direction for final discharging, so that when the water heat is put into operation, upon the burner carrying out combustion, the burner conducts, along a circumference thereof, first-time heat exchange by heating an inside surface of the water tank, and then the burner carries out second-time heat exchange by heating an arc top portion of the water tank through ascending flame generated thereby, and finally, flame gas generated by the burner is guided by the arc top portion of the water tank to flow downward through the radially arranged flame tubes to carry out a third-time heat exchange, whereby thermal efficiency is remarkably increased. Compared to the conventional water heaters that conduct only one time heat exchange to heat water, this allows more complete use of the heat generated by combustion to heat water and remarkably lowers the temperature of the exhaust gas to reduce the damage caused by step-by-step accumulation of warming effect to the environment. Thus, simultaneous with the extremely high thermal efficiency in heating water, the exhaust gas discharged is made more environmentally conservative.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
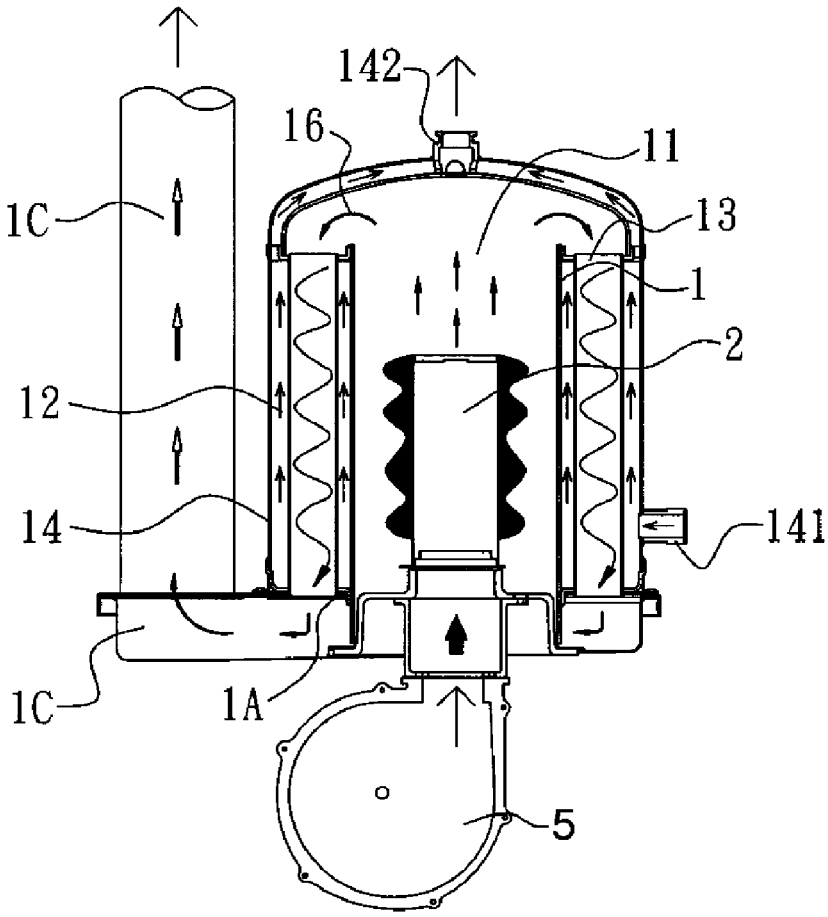
FIG. 1 is a cross-sectional view illustrating the structure of a water heater with enhanced thermal efficiency in accordance with the present invention.
Figure 2:
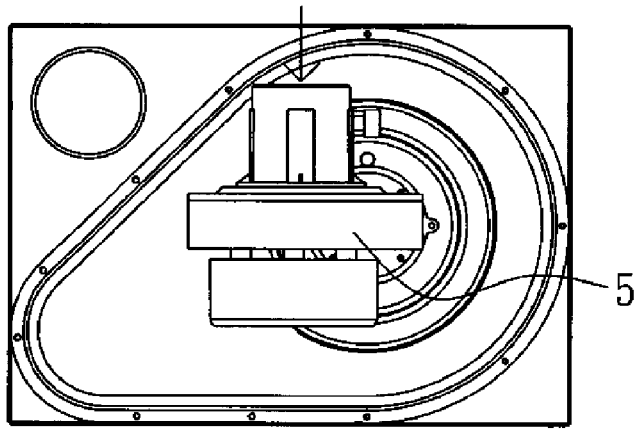
FIG. 2 is a bottom view of FIG. 1.

The present invention will now be explained with reference to the drawings, of which FIG. 1 is a cross-sectional view illustrating the structure of a water heater with enhanced thermal efficiency in accordance with the present invention and FIG. 2 is a bottom view thereof. As shown in these drawings, the water heater constructed in accordance with the present invention comprises a heat exchange tank 1, a water tank 14 that houses the heat exchange tank 1 and shields and isolates the heat exchange tank 1 with a surrounding curtain of water flow running therethrough, a burner 2, and a blower 5. The burner 2 is connected to a combustible gas outlet opening 5A of the blower 5 and extends upward from a central portion of a base 1A of the heat exchange tank so as to form a combustion chamber in an internal cavity 11 of the heat exchange tank. A plurality of radially arranged flame tubes 13 extends downward from a circumferential top corner of the internal cavity 11. The lame tubes 13 are surrounded by water flowing inside the water tank 14 and are extended to communicate with an exhaust gas discharge tube 1C arranged circumferentially of and separated from the heat exchange tank base 1A for discharging in an upward-bent direction. The water tank 14 is provided with a cold water inlet port 141 formed in a lower portion of a side wall thereof and is also provided with a hot water outlet port 142 formed in a central portion of a top of the water tank 14.

Figure 3:
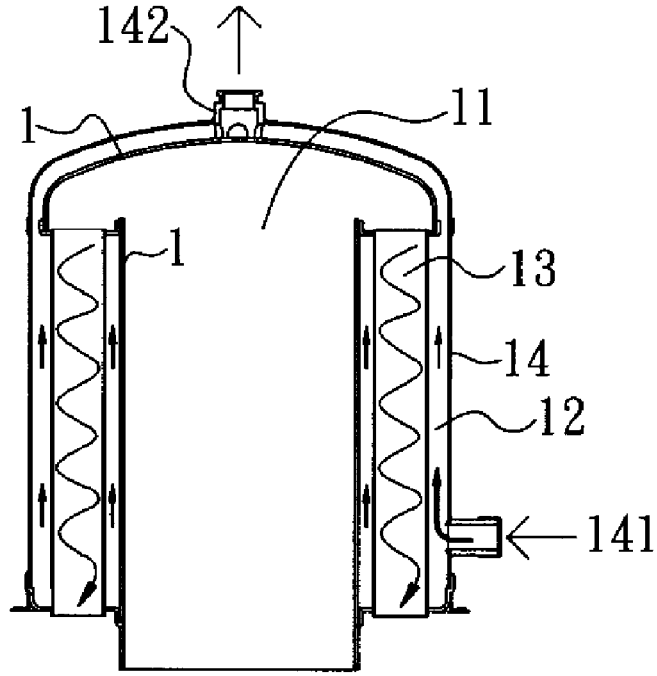
FIG. 3 is a cross-sectional view showing a heat exchange tank of the water heater of the present invention combined with a water tank.
Figure 4:
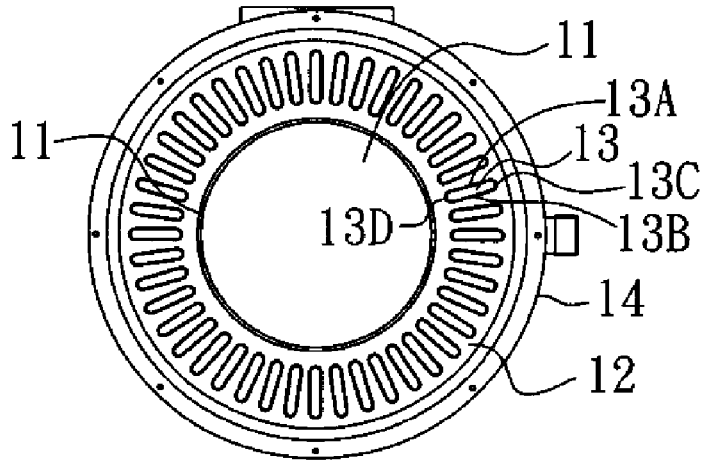
FIG. 4 is a bottom view of FIG. 3.

The flame tubes 13 that are arranged in a downward depending condition around the heat exchange tank 1 and the water tank 14 are configured and set with respect to each other as illustrated in FIG. 3, which is a cross-sectional view showing the heat exchange tank of the water heater of the present invention combined with the water tank, and FIG. 4, which shows a bottom view thereof. The heat exchange tank 1 and the water tank 14 are both a cylindrical tank having an opening end facing downward and a closed top end bulging outward in an arc form. The water tank 14 has a tank diameter greater than the heat exchange tank 1 and circumferentially houses the heat exchange tank 1 and the downward-extending flame tubes 13 arranged circumferentially around the heat exchange tank 1 by being partitioned to form a heat exchange chamber 12 in a circumferential form. The lame tubes 13 are constructed to form a wide flat tube by specially shaping the cross section thereof, whereby the ratio of surface area to cross-sectional area is increased to, on one hand, increase the heat exchange area and, on other hand, slow down the flow of flume gas, so as to prompt and more effectively conduct heat exchange on heat dissipation surfaces 13A, 13B, 13C, 13D. In addition, due to the wide flat tubular configuration and the radial arrangement of the lame tubes 13 inside the water tank 14, the overall size of the water tank 14 can be reduced, and weight is reduced too, and also, the amount of water preserved inside the water tank 14 can be lessened to make it possible to instantaneously increase the temperature of water. Further, inside the lame tubes 13, passages of corrugated configuration can be arranged to further slow down the flow of flame gas and increase heat exchange area.

Thus, a water flow 15 to be heated can be introduced into the partitioned space 12 through the cold water inlet port 141 at the lower side portion of the water tank 14, and the flame gas 16 in combustion, once ascending to the internal top of the heat exchange tank 1, is forced to move laterally and enters the lame tubes 13 for descending therealong. The flame gas 16, during the whole process of ascending and descending, gives off heat to the water flow 15, whereby the water flow 15, when reaching the top of the heat exchange tank 1, completely absorbs the heat induced by combustion, and thus supplying hot water to the hot water outlet port 142 for subsequent use for washing. Thus, the flowing directions of both the flame gas 16 and the water flow 15 and the portions thereof that carry out heat exchange both comply with the fundamental fluid movement pattern that hot flow goes up and cold flow goes down.

Figure 5:
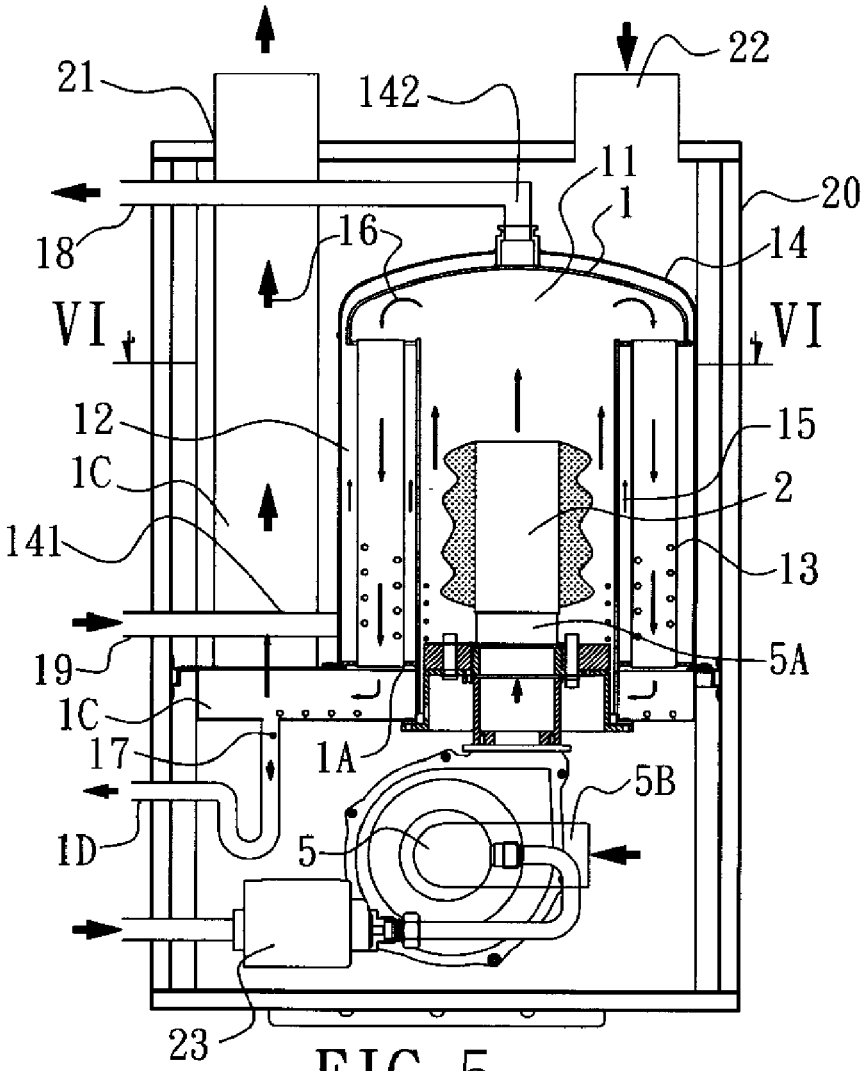
FIG. 5 is a schematic view showing an example embodiment of actual application of the water heat with enhanced thermal efficiency in accordance with the present invention.
Figure 6:
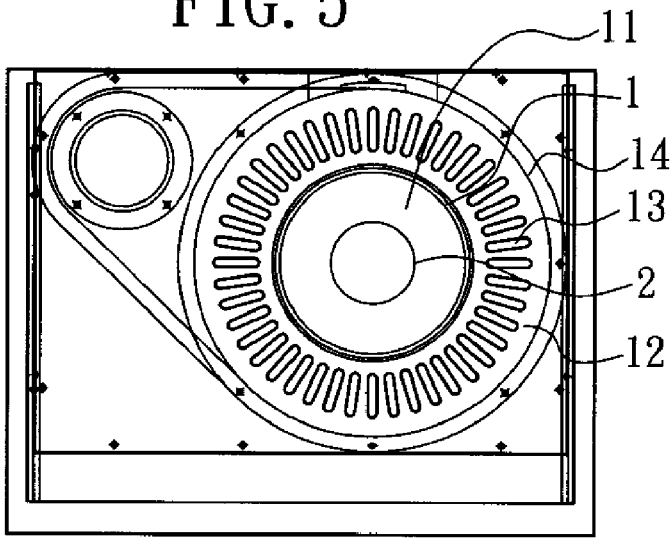
FIG. 6 is a cross-sectional view taken along line V-V of FIG. 5.

An actual application is illustrated in the drawing of example embodiment shown in FIG. 5 and a cross-sectional view thereof shown in FIG. 6. The overall structure is housed in an enclosure 20 and the enclosure 20 forms an exhaust opening 21 through which an upward-bent section of the exhaust gas discharge tube 1C extends. The enclosure 20 also forms an air intake opening 22. A hot water supply tube 18 is fit to the hot water outlet port 142 and a cold water supply tube 19 is fit to the cold water inlet port 141. A combustible gas outlet of a proportional valve 23 that is commonly used handle air/fuel ratio is connected through a pipe to an inlet 5B in order to realize a function of heating water immediately upon being actuated. For a practical arrangement, the cold water inlet port 141 of the water tank 14 can be set at a location close to the upward-bending of the exhaust gas discharge tube 1C. A drainage tube 1D can be provided to the exhaust gas discharge tube 1C at a location opposing a point at one side of a bottom wall of the heat exchange tank base 1A, to drain condensed water 17 contained in the flame gas 16.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water heater comprising:

a blower, which conveys combustible gas;

a burner, which is connected to a combustible gas outlet opening of the blower;

a heat exchange tank, which has an opening facing downward and comprises a base having a central portion from which the burner extends upward into the heat exchange tank to form a combustion chamber within an internal cavity of the heat exchange tank, a plurality of radially arranged flame tubes that have a cross section forming a wide flat tube extending downward from a top corner of the internal cavity, an exhaust gas discharge tube being set circumferentially of and separated from the base and in communication with the flame tubes for conducting flame gas in an upward-bent direction for discharging, and a water tank having an opening facing downward and having a tank diameter greater than the heat exchange tank, the water tank being partitioned to define a single partitioned space for water to be heated to flow therethrough and circumferentially housing the heat exchange tank and the downward-extending flame tubes arranged circumferentially around the heat exchange tank and received in the partitioned space of the water tank in a circumferentially spaced manner, the water tank forming a cold water inlet port in a lower side portion thereof and a hot water outlet portion in a central top portion thereof, wherein in operation, the burner carries out, along a circumference thereof, first-time heat exchange by heating an inside surface of the water tank, and then the burner carries out second-time heat exchange by heating an arc top portion of the water tank through ascending flame generated thereby, and finally, flame gas generated by the burner is guided by the arc top portion of the water tank to flow downward through the radially arranged flame tubes to carry out a third-time heat exchange, whereby thermal efficiency is remarkably increased.

2. The water heater according to claim 1, wherein the flume tubes comprise corrugated passages therein.

3. The water heater according to claim 1, wherein the heat exchange tank and the water tank are both a cylindrical tank having a closed top end that bulges outward in an arc form.

4. The water heater according to claim 1, wherein the exhaust gas discharge tube is provided with a drainage tube at a location opposing a point at one side of a bottom wall of the heat exchange tank base.

5. The water heater according to claim 1, wherein the cold water inlet port of the water tank is set at a location close to the upward-bending of the exhaust gas discharge tube.

* * * * *